United States Patent [19]

Khait

[11] 4,173,829

[45] Nov. 13, 1979

[54] DRAFTING INSTRUMENT

[76] Inventor: George Khait, 516-28th Ave. #3, San Francisco, Calif. 94121

[21] Appl. No.: 899,943

[22] Filed: Apr. 25, 1978

[51] Int. Cl.[2] ..... B43L 9/04

[52] U.S. Cl. ..... 33/27 C

[58] Field of Search ..... 33/27 C, 41 B

[56] References Cited

U.S. PATENT DOCUMENTS

| | | | |
|---|---|---|---|
| 392,143 | 10/1888 | Wright | 33/27 C |
| 2,470,035 | 5/1949 | Hudkins | 33/27 C X |
| 2,542,537 | 2/1951 | Klemm | 33/27 C |
| 2,607,990 | 8/1952 | Payamps | 33/27 C |

FOREIGN PATENT DOCUMENTS

| | | | |
|---|---|---|---|
| 587609 | 6/1932 | Fed. Rep. of Germany | 33/27 C |
| 560382 | 4/1944 | United Kingdom | 33/27 C |

*Primary Examiner*—Charles E. Phillips

*Attorney, Agent, or Firm*—David Pressman

[57] ABSTRACT

A template for drawing accurately-positioned circular or straight lines regardless of the tip angle and diameter of the writing instrument used therewith has specially-shaped holes positioned at respectively different, predetermined spacings from a reference point, which may be an edge of the template or a pivot point on the template. Each hole has an elongated shape with opposed edges which converge at acute angles and which are equidistantly spaced from the line the hole is provided to draw. The holes may be arranged in parallel rows and spaced predetermined distances from either a single pivot point or multiple pivot points, or they may be in radial rows emanating from a single pivot point. The pivot point may comprise a pierced removable insert to accept wear from a pivot such as a tack, or it may be a hole in the template with a pivot point springably mounted adjacent the hole and lowerable thereinto.

16 Claims, 9 Drawing Figures

DRAFTING INSTRUMENT

FIELD OF INVENTION

This invention relates to drafting equipment, specifically to a drafting template which can be used to draw circular or straight lines by placing a writing instrument in a hole in the template and moving the writing instrument and the template in unison.

PRIOR ART

Heretofore, line-drawing templates of the type described had small circular holes to receive the tip of a pencil or other writing instrument. As the line was drawn by moving the writing instrument with the template—either around a pivot point on the template to draw circles, or translating the entire template along a straightedge to draw lines—the line could not be drawn at a precise location, even if the hole was precisely positioned from the pivot point or edge of the template and even though the tip of the writing instrument had a sharp point. This is because the diameter of the tip of the writing instrument at the point of its contact with the inside of the hole of the template varied greatly between different writing instruments (due to variations in the tip angle), thereby causing the position of the point of the instrument to vary with the diameter of the tip of the writing instrument.

For example, in a circle-drawing template the tip of the pencil usually will bear against the edge of the hole remote from the pivot point as the template is rotated. Thus the point of the pencil will be spaced in from the outside edge of the hole by one-half the diameter of the pencil at the point it contacts the hole, thereby causing the pencil to draw a circle line whose position is dependent upon the diameter of the pencil at the point it contacts the hole. A pencil with a relatively large tip angle will have a relatively large diameter at the point it contacts the hole, causing the radius of the circle drawn to be slightly smaller than one drawn by a pencil having a relatively small tip angle.

Accordingly it is one object of the present invention to provide a line-drawing template which can enable lines to be drawn with more accurate positioning, regardless of the tip angle or diameter of the writing instrument.

Also when templates of the type described are used to draw circles, it has been found that the number of circles a template of a given size is able to draw has heretofore been limited. It is accordingly another object of the present invention to provide a circle-drawing template which can make a far greater number of circles of different radii than heretofore available for a given size template.

Many other objects and advantages of the present invention will become apparent from a consideration of the ensuing description thereof.

DRAWING FIGURES

REFERENCE NUMERALS

10—center pivot hole
12—springably mounted pivot point
14—pencil hole
16—pencil
18—circle line
20—radius of hole 14
22—outer edge of hole 14
23—inner edge of hole 14
24—radius of hole 14
26—left acute angle or intersection point
28—right acute angle or intersection point
30—central radius of hole 14
32—section of pencil with small diameter tip
34—section of pencil with large diameter tip
36—hole with straight outer edge
38—straight outer edge of hole 36
40—convex inner edge of hole 36
42—radius of hole 36
44—section of pencil with small diameter tip
46—section of pencil with medium diameter tip
48—section of pencil with large diameter tip
52—ruled edge
55—straight line
56—leading edge of template
58—straight edge for guiding template
60—motion lines
62—pivot hole
64—removable insert
66—tack

FIG. 1—RECTANGULAR TEMPLATE WITH SINGLE PIVOT

Figure 1:
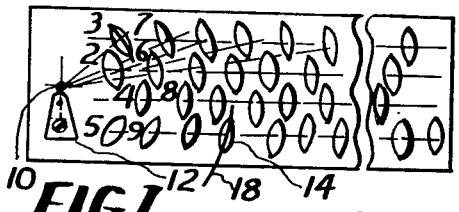
FIG. 1 is a plan view of a circle-drawing template having a single pivot point with pencil holes arranged in parallel rows.
Figure 8:
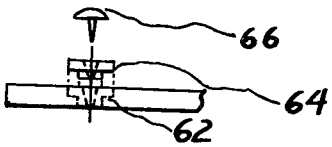
FIG. 8 is a sectional view of a template's pivot point section in which the pivot means has a removable insert and thumb tack.
Figure 9:
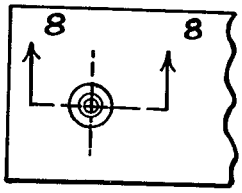
FIG. 9 is a plan view of the template section of FIG. 8.

The template of FIG. 1 is preferably formed of a transparent plastic material, such as polycarbonate, an acrylic monomer such as those sold under the trademarks LUCITE or PLEXIGLAS, or it may be a more expensive and durable polymer such as that sold under the trademark LEXAN. It has a center pivot hole 10 through which a springably mounted pivot point 12, which is shown in more detail in FIG. 7 and which is attached to the template, may be lowered. Alternatively a thumbtack (shown in FIG. 8) may be inserted through the hole in lieu of springably mounted pivot point 12. The template has a plurality of circle-guiding or pencil holes, such as 14, each of which is spaced a different radius from the center of pivot hole 10. In the example shown, the radii (not to scale) are in millimeters, the radial spacings of several of the holes being indicated.

The template of FIG. 1 may be of any convenient length, say 15 to 30 cm., and may have a width of about 3 cm. It may be about 1 mm. thick. However, these dimensions are exemplary and various other dimensions will be apparent to those skilled in the art. Due to the length of the template, only two separated portions thereof are shown and a large portion is removed as indicated by the break line.

Circles are drawn with the template by pushing pivot point 12 through hole 10 at the center of the desired circle and then inserting a writing instrument, such as pencil 16 (FIG. 7), into the hole whose indicated spacing from pivot hole 10 corresponds to the desired circle radius. Then the pencil is used to rotate the template about the pivot point so that the template will guide the pencil in a true circle.

In the rest of this description the writing instrument will be described as a pencil. However it is to be understood that any other type of writing instrument, such as pen, stencil, metal engraver or the like, may alternatively be used.

The holes on the template are arranged in parallel rows and are angled to face pivot 10. In every row, adjacent holes are equidistantly spaced and the holes of adjacent rows are staggered so that the holes overlap, whereby a maximum number of holes can be provided on the template. Each hole has a unique spacing from pivot 10 so as to provide maximum circle-drawing capability.

In the example shown, adjacent holes in each row are spaced 4 mm. apart and the first hole on the top row is 3 mm. from pivot 10 so that the holes in the top row can be used to circumscribe circles having radii of 3, 7, 11, 15, etc. mm. The first hole in the second row has a radius of 2 mm.; thus the holes in the second row can be used to circumscribe radii of 2, 6, 10, 14, etc. mm. The first hole in the third row has a radius of 4 mm. so that the holes in the third row can be used to circumscribe radii of 4, 8, 12, 16, etc. mm. The holes in the fourth row can be used to circumscribe radii of 5, 9, 14, 19, etc. mm. Thereby, by so staggering the holes, circles of all of the possible radii down to a resolution of 1 mm. can be circumscribed by the template.

According to the invention, each of the holes in the template has a unique shape, explained below, which enables the circle to be drawn with precise positioning from the center of pivot hole 10, regardless of the tip diameter or angle of the pencil used.

FIG. 2—HOLE GEOMETRY

Figure 2:
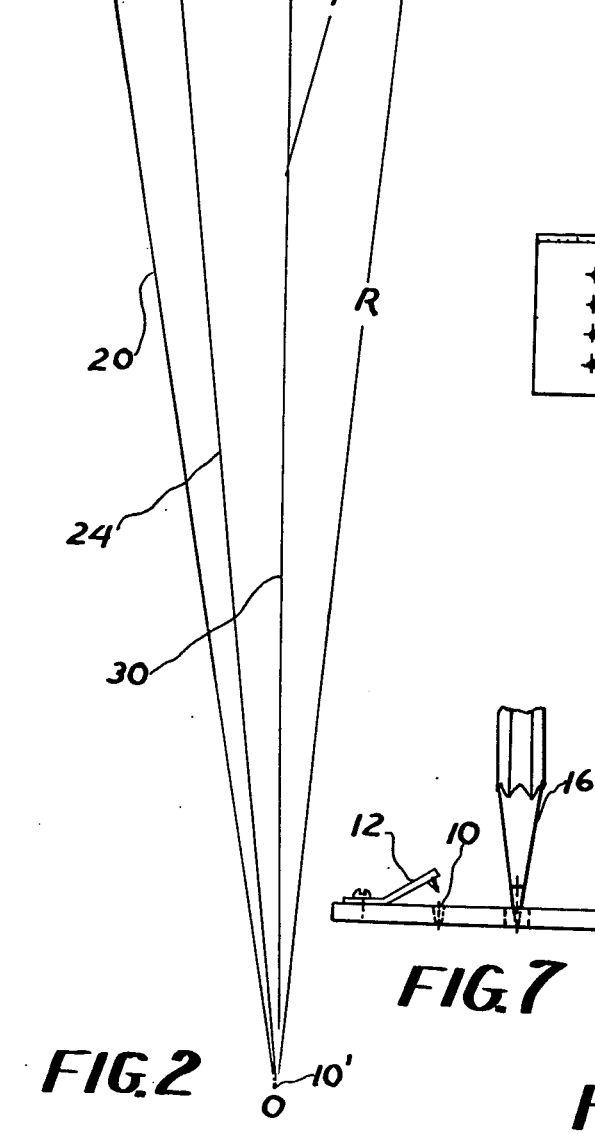
FIG. 2 is a diagrammatic showing of a pencil hole and construction geometry according to the invention; the hole has a curved outer edge.

FIG. 2 is an enlarged view of a hole 14 according to the invention which is designed to enable a pencil to draw a circle line 18 a precise radius R from a center point 10'.

Hole 14 has an elongated shape such that along any radius therethrough, corresponding points on opposite edges 22 and 23 of the hole are equidistantly spaced from line 18, which represents the circle to be drawn. For example, on radius 20, point A is the intersection of radius 20 with circle line 18, point B is the intersection of radius 20 with the outer edge 22 of hole 14, and point C is the intersection of radius 20 with the inner edge 23 of hole 14. The hole is shaped such that points B and C are equidistant from point A, i.e., AB=AC. Similarly, on radius 24 (or on any other radius) the intersection D of radius 24 with circle line 18 is equidistant from the intersections of radius with the outer (22) and inner (23) edges E and F of hole 14, such that DE=DF.

Also note that outer edge 22 of hole 14 converges with inner edge 23 to form two opposite acute angles or intersection points 26 and 28.

So long as these general criteria are satisfied, i.e., the confronting edges of the hole converge to form at least one acute angle and corresponding points on the respective converging edges along perpendiculars to line 18 are equidistantly spaced frome line 18, the outer and inner edges of the hole can have any shape desired. In the preferred example shown in FIG. 2, outer edge 22 has a concave shape when viewed from line 18 and is actually a portion of a circle having a radius r, which has a lesser diameter than R, the radius of circle 18.

Hole 14 may be constructed by the following steps: (1) Draw circle line 18 of radius R with a compass. (2) Draw a radius line 30 from the compass's pivot point 10' through circle line 18. (3) With a compass having its point positioned on line 30 between point 10' and line 18, draw a circle having a radius r (less than R) which intersects circle 18 at points 26 and 28. (4) Construct inner edge 23 of hole 14 by using dividers to mark a series of points whose radial spacings inward from circle line 18 are equal to the radial spacings from circle line 18 outward to outer edge 22 of the circle line 20. E.g., measure distance AB along radius 20 and then mark point C along radius 20 such that AC=AB. (5) Connect all points, e.g., 26, C, F, etc., with a curved line to form inner edge 23 of circle 14. (Once hole 14 is thusly drawn, the technology to produce a template with holes according to the invention is well known.) The hole may be about 3×6 mm. in maximum dimensions.

Because of the equidistant spacings of outer and inner edges 22 and 23 of hole 14 from circumference segment 18, the point of a pencil of any diameter or tip angle will always lie precisely on line 18, provided that the pencil is moved along line 18 until it is positioned in the narrowest portion of hole 14 in which its tip can fit.

Consider, for example, a pencil having a relatively small tip angle, and hence a relatively small diameter at the point it contacts hole 14, as shown in section at 32. When pencil 32 is positioned into the narrowest portion of hole 14 in which it can fit, its point will be precisely on the same line 18 as will a correspondingly positioned pencil of larger tip angle and diameter, as indicated by pencil section 34.

FIG. 3—HOLE GEOMETRY (STRAIGHT OUTER EDGE)

Figure 3:
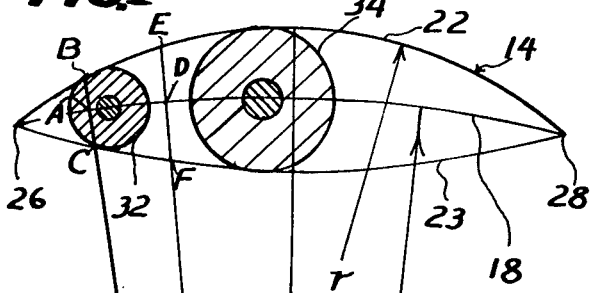
FIG. 3 is a diagrammatic showing of a hole according to the invention having a straight outer edge in two sections.
Figure 3:
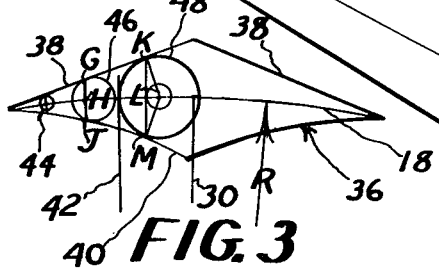

As stated, the shape of the outer edge of the pencil hole can have many shapes. In FIG. 3 a hole 36 has a two-section straight outer edge 38 and, of necessity, a two-convex-section inner edge 40, both edges being radially equidistant from circumference line 18. Thus along any radial line, such as 42, the point of its intersection H with circle line 18 will be equidistant from its points of intersection G and J with outer edge 38 and inner edge 40 of hole 36, so that HG=HJ. Thus pencils having either a small tip angle and diameter, such as 44, medium tip angle and diameter, such as 46, and large tip angle and diameter, such as 48, will all have their points lying precisely on line 18 when they are cammed to the narrowest portion of hole 36 into which they will fit. Regarding large diameter pencil 48, despite the fact that the points of contact of its tip with outer edge 38 and inner edge 30 of hole 36 lie along a different radius than the tip of the pencil, the pencil will still be "on line" because the distance from the tip L to the outer point of contact K will be the same as the distance from point L to the inner point of contact M.

Hole 36 may be constructed as follows: (1) Draw a circle segment 18 having a radius R. (2) Draw a central radius line 30. (3) Draw straight outer edge sections 38 of hole 36 with a straightedge such that edges 38 join at a point on radius 30 and intersect circumference segment 18 at equidistant points from radius 30. (4) Construct convex inner edge 40 by using a dividers to mark a series of points whose radial spacings inward from line 18 are equidistant to the spacings of respectively corresponding radial points on outer edge 38 outward from line 18, just as inner edge 23 was constructed in FIG. 2. (5) Interconnect the points to form two-section inner edge 40.

FIG. 4—TRIANGULAR TEMPLATE

Figure 4:
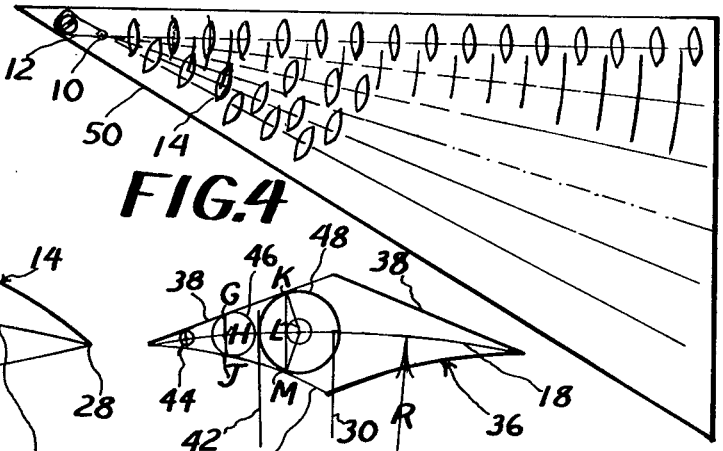
FIG. 4 is a plan view of a triangular circle-drawing template having a single pivot point with pencil holes arranged in radial rows.

In FIG. 4 a triangular template is provided having a single center hole 10 and a springably mounted pivot point 12. Along a series of radial lines from hole 10 a plurality of holes such as 14 are provided, each of which has a unique radial spacing from hole 10. For the purpose of ease of illustration, not all of the holes are shown. At the righthand, wide portion of the template, the holes on each radius are preferably equidistantly spaced and are staggered along different radii such that a complete series of radii down to a minimum resolution are provided. At the narrow, lefthand portion of the template, some holes must be omitted because of limited area, thus sacrificing resolution in the range of smaller radii holes.

FIG. 5—RECTANGULAR TEMPLATE, PLURAL PIVOT HOLES

Figure 5:
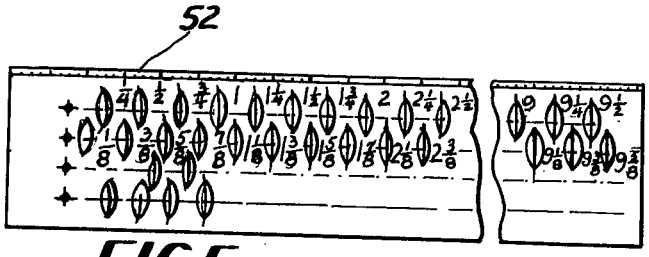
FIG. 5 is a plan view of a combination circle-drawing template and ruler having a plurality of pivot points with holes arranged in parallel rows.

The template of FIG. 5 is similar to that of FIG. 1 except that it has a respective pivot hole for each row of pencil holes and also has a ruled edge 52 to provide a ruler. As in the embodiment of FIG. 1, the holes in each row are equidistantly spaced and the holes are staggered in the respective rows. The holes have radial spacings according to the British system; in each row the holes are spaced every ¼ inch and the four rows can thus provide a resolution down to 1/16 inch. Due to the use of respective pivot holes, all of the pencil holes can face identical directions, in contrast to those of FIG. 1.

FIG. 6—STRAIGHT LINE DRAWING TEMPLATE

Figure 6:
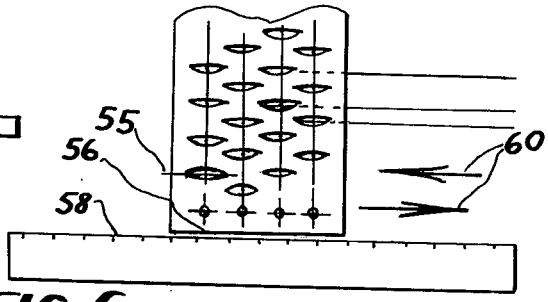
FIG. 6 is a straight line drawing template and straightedge.

The template of FIG. 6 can be used to draw straight lines, such as 55, having precise spacings from a leading edge 56 of the template by positioning the template along a straightedge 58, which can be a T-square or the like, putting a pencil in the hole having the desired distance from edge 56, and translating the template by means of the pencil (not shown) in the direction indicated by arrows 60. In this case each pencil hole would have a symmetrical shape about its straight line, such as 55, i.e., corresponding points on the opposite edges of each hole would be equidistantly spaced from a straight line bisecting the hole.

According to the invention, regardless of the diameter of the tip of the pencil which is used to draw these lines, by virtue of the unique configuration of the holes in the template of FIG. 5, each line's spacing from reference edge 56 will be precise.

FIG. 7—PIVOT MEANS 12

As noted previously, center hole 10 can simply be used with a point of any type, such as thumbtack, but preferably a pivot point 12 is springably mounted, e.g., by means of a screw as indicated, such that by pushing down on the top of the point, it can be made to extend through hole 10 and pierce the paper, thereby providing a fixed pivot point for the template, whereafter it can be pulled back up to its rest position indicated. The rest position of the pivot point is preferably well above hole 10 as indicated, so that the draftsperson can see the center on the paper through hole 10.

FIG. 8—PIVOT HOLE WITH REMOVABLE INSERT

Figure 7:
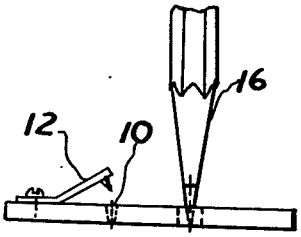
FIG. 7 is a side sectional view of a portion of a template showing a pencil hole, a pivot means and one hole with a springably mounted pivot point, and a pencil in the pencil hole.

As an alternative to the hole and springably mounted pivot point arrangement 10–12 of FIG. 7, a hole 62 may be provided having a removable insert 64, e.g., of brass, which is designed to take wear of a tack 66 or other pivot point designed to be inserted through a hole in removable insert 64. In this way if, through use, the diameter of the hole through insert 64 wears so that the template will tend to wobble while it is rotated, the insert can be removed and a new insert can be mounted, e.g., by force fit or with the aid of cement.

While the above description contains many specificities, these should not be construed as limitations upon the scope of the invention, but merely as examples of preferred embodiments thereof. Many other ramifications are possible. For example, the hole can have shapes other than those shown (provided the criteria indicated are satisfied), the templates can have circular, square, or other shapes, different pivot arrangements can be provided, different pencil hole arrangements, such as spiral, can be provided. Accordingly, the true scope of the invention should be limited only by the appended claims and their legal equivalents.

I claim:

1. A circle drawing template of the type comprising a flat sheet of solid material having (a) pivot means for enabling said sheet to be rotated on a planar surface about a pivot point on said sheet, and (b) at least one hole on said sheet spaced from said pivot point for receiving the tip of a writing instrument in order to guide movement of said instrument along a curved circumferential line spaced by a given radius from said pivot point, characterized in that one portion of said hole has mutually confronting edges, corresponding points of which along any radius from said pivot point through said portion of said hole are spaced equidistantly from said curved circumferential line, the confronting edges of said hole leading away from said one portion of said hole being likewise equidistantly spaced from said curved circumferential line and converging together at a location on said circumferential line remote from said one portion of said hole to form a corner of said hole on said line, whereby when a writing instrument having a point is placed in said hole and moved toward the converging portion of said confronting edges and such as to rotate said flat sheet about said pivot point, said point of said writing instrument will be guided precisely along said curved circumferential line regardless of the tip diameter or tip angle of said writing instrument.

2. The drafting instrument of claim 1 wherein at least one of said converging edges of said hole is curved.

3. The drafting instrument of claim 1 wherein each of said converging edges of said hole is curved so as to present a concave shape when viewed from said circumferential line.

4. The drafting instrument of claim 1 wherein one of said converging edges of said hole is straight and the other is curved so as to present a convex shape when viewed from said circumferential line.

5. The drafting instrument of claim 1 wherein two pairs of confronting edges of said hole lead away from said one portion thereof, each pair converging together at a location remote from said one portion of said hole, the respective converging edges of each pair being equidistantly spaced from said circumferential line.

6. The drafting instrument of claim 5 wherein said converging edges are curved such that the corresponding edges of separate pairs form one continuous, smooth edge which is curved so as to present a concave shape when viewed from said circumferential line.

7. The template of claim 1 wherein said sheet contains a plurality of said holes, each having the shape of said first-described hole, said holes being spaced respectively predetermined distances from said pivot point, the confronting and converging edges of each of said holes being equidistantly spaced about a respective curved circumferential line, whereby a plurality of circles of respectively different radii can be drawn by use of said holes.

8. The drafting instrument of claim 7 wherein said pivot means comprises means for pivotably fixing said instrument at one point so that it can be rotated, in a single plane, about said point.

9. The invention of claim 8 wherein said template has a plurality of pivot means at different locations thereon, each of said pivot means being spaced a predetermined distance from a plurality of said holes.

10. The drafting instrument of claim 8 wherein said pivot means comprises a relatively large hole in said sheet of material and having a removable insert mounted therein, said insert having a relatively small hole therein.

11. The drafting instrument of claim 8 wherein said pivot means comprises a hole in said sheet of material and a pivot point means mounted adjacent said hole and arranged to be lowerable through said hole to provide a fixed pivot for said instrument.

12. The drafting instrument of claim 7 wherein said holes are positioned along a plurality of radii emanating from said pivot point, adajcent holes along each radius being spaced equidistantly from each other.

13. The drafting instrument of claim 7 wherein said holes are positioned along a plurality of parallel rows, a plurality of holes in each row, and including a plurality of said pivot points, each on a respective one of said plurality of parallel rows, each hole having a unique spacing from the pivot point on its row.

14. A circle drafting template comprising a flat sheet of a solid material having pivot means for enabling said template to be rotated about said pivot means in a single plane on a flat surface, a plurality of rows of holes in said template, each of said holes having an exclusive spacing from said pivot means so as to enable a plurality of circles of different radii to be drawn by placing a writing instrument in said holes and rotating said template therewith, adjacent rows of holes being sufficiently closely spaced and the holes in adjacent rows being positioned with staggered spacings such that the holes in adjacent rows overlap when viewed from a location between the ends of said rows, each of said holes being shaped to have confronting edges on opposite sides of a circumference line of a circle, the center of which is at said pivot means, said confronting edges being most widely spaced along one radius from said pivot means and converging therefrom to join and form an acute angle on said circumference line, corresponding points of said confronting edges along any radius through said hole being equidistantly spaced from said circumference line.

15. The template of claim 14 wherein said pivot means comprises a single pivot point, said plurality of rows of holes being positioned in radial rows emanating from said single pivot point.

16. The template of claim 14 wherein said pivot means comprises a plurality of pivot points, said plurality of rows of holes being positioned in parallel rows, each of which lies on a line intersecting a respective one of said pivot points.

* * * * *